US010826154B2

(12) United States Patent
Matchett et al.

(10) Patent No.: US 10,826,154 B2
(45) Date of Patent: Nov. 3, 2020

(54) CONCEALED COMMUNICATIONS ANTENNA AND LIGHTING FEATURE

(71) Applicant: ENE-HUB PTY LTD, North Sydney, North South Wales (AU)

(72) Inventors: Robert Stephen Matchett, Chippendale (AU); Mark Robert James West, Chippendale (AU); Scott Daniel Williams, Chippendale (AU)

(73) Assignee: ENE-HUB Pty Ltd, North Sydney (AU)

( * ) Notice: Subject to any disclaimer, the term of this patent is extended or adjusted under 35 U.S.C. 154(b) by 0 days.

(21) Appl. No.: 16/320,887

(22) PCT Filed: Jul. 26, 2017

(86) PCT No.: PCT/AU2017/050773
§ 371 (c)(1),
(2) Date: Jan. 25, 2019

(87) PCT Pub. No.: WO2018/018083
PCT Pub. Date: Feb. 1, 2018

(65) Prior Publication Data

US 2019/0165446 A1 May 30, 2019

(30) Foreign Application Priority Data

Jul. 26, 2016 (AU) ..... 2016902940

(51) Int. Cl.
*H01Q 1/06* (2006.01)
*H01Q 1/42* (2006.01)
(Continued)

(52) U.S. Cl.
CPC ..... *H01Q 1/06* (2013.01); *F21S 8/088* (2013.01); *F21V 33/00* (2013.01); *H01Q 1/246* (2013.01);
(Continued)

(58) Field of Classification Search
CPC .. H01Q 1/06; H01Q 1/12; H01Q 1/42; H01Q 1/44; F21S 8/00; F21S 8/08; F21S 8/085; F21S 8/088
See application file for complete search history.

(56) References Cited

U.S. PATENT DOCUMENTS 5,963,178 A * 10/1999 Jones ..... H01Q 1/06 343/890
7,116,279 B1 * 10/2006 Chan ..... H01Q 1/06 343/721
(Continued)

FOREIGN PATENT DOCUMENTS

EP 1376755 A1 1/2004

*Primary Examiner* — Jason Crawford
(74) *Attorney, Agent, or Firm* — Baker Botts L.L.P.; Michael A. Sartori

(57) ABSTRACT

A concealed communication antenna and lighting feature comprises a mount having base configured to be mounted to a structure and having a circumferentially disposed side wall adjacent the circumference of the base. The outer side wall defining a seat extending a radial distance from the outer side wall to the edge of the base circumference, and an inner wall disposed concentrically within the outer side wall. A plurality of solid state lighting elements adapted to direct light away from the base. A communications antenna is mounted to the inner side wall and a radome is disposed about the antenna and extends above the inner side wall. The radome is closed at an upper end and a lighting feature lens mounted to the outer wall. The lighting feature lens being closed at a top end such that the solid state lighting elements direct light intermediate the radome and the lighting feature lens.

5 Claims, 7 Drawing Sheets

(51) Int. Cl.

| | |
|---|---|
| ***H01Q 1/44*** | (2006.01) |
| ***F21V 33/00*** | (2006.01) |
| ***H01Q 1/24*** | (2006.01) |
| ***F21S 8/08*** | (2006.01) |
| *H01Q 1/12* | (2006.01) |
| *F21Y 115/10* | (2016.01) |
| *F21S 8/00* | (2006.01) |
| *F21W 131/103* | (2006.01) |
| *F21Y 115/15* | (2016.01) |
| *F21Y 103/33* | (2016.01) |

(52) U.S. Cl.
CPC ..... *H01Q 1/42* (2013.01); *H01Q 1/44* (2013.01); *F21S 8/00* (2013.01); *F21W 2131/103* (2013.01); *F21Y 2103/33* (2016.08); *F21Y 2115/10* (2016.08); *F21Y 2115/15* (2016.08); *H01Q 1/12* (2013.01)

(56) References Cited

U.S. PATENT DOCUMENTS

| | | | | |
|---|---|---|---|---|
| 71,116,279 | | 10/2006 | Chan et al. | |
| 7,731,383 | B2 * | 6/2010 | Myer | F21V 29/83 362/145 |
| 8,593,370 | B2 * | 11/2013 | Caldwell | H01Q 1/1242 343/890 |
| 8,749,449 | B2 * | 6/2014 | Caldwell | H01Q 1/1242 343/890 |
| 10,199,712 | B1 * | 2/2019 | Boyle | H01Q 1/1242 |
| 2004/0080461 | A1 * | 4/2004 | Rothgeb | H01Q 1/44 343/720 |
| 2011/0299299 | A1 * | 12/2011 | Kim | H01Q 1/42 362/612 |
| 2012/0206306 | A1 * | 8/2012 | Hager | H01Q 1/246 343/721 |
| 2015/0045093 | A1 * | 2/2015 | Hansen, Sr. | H01Q 1/44 455/561 |
| 2015/0349399 | A1 * | 12/2015 | Lasier | H01Q 1/1242 343/721 |
| 2017/0098884 | A1 * | 4/2017 | Barnickel | H01Q 19/062 |
| 2017/0238432 | A1 * | 8/2017 | Lapham | H05K 5/0213 362/225 |
| 2018/0277921 | A1 * | 9/2018 | Ming | H01Q 1/42 |

* cited by examiner

SECTION B-B
SCALE 1 : 2

CONCEALED COMMUNICATIONS ANTENNA AND LIGHTING FEATURE

FIELD OF THE INVENTION

The present invention relates to communications antennae, and, in particular, to a concealed communications antenna and lighting feature unit.

BACKGROUND ART

The invention has been developed primarily for use with lighting poles and will be described hereinafter with reference to this application. However, it will be appreciated that the invention is not limited to this particular field of use and is applicable to other vertically extending structures such as telegraph or electricity poles, or to building facades or roofs, for example.

Telecommunications antenna such as cellular telephone transceivers and line of site microwave transceivers, for example are considered ancillary equipment and are required to be placed in particular locations to provide necessary coverage to adjacent users. Typically, telecommunications antenna or transceivers are simply bolted on to the facade or roof of a building or to intermediate support structures crudely attached to the building. In many locations, buildings in particular are not of a sufficient height or are simply not present in areas requiring communication coverage and telecommunications antenna are generally bolted or bracketed onto an existing substantially vertical telegraph pole or light pole, or a pole erected for that purpose. In the case of light poles, these are often used in urban or city areas, whether for convenience or because of the absence of telegraph poles such as where electricity supplies are buried.

When mounted to most poles, the communication antennas are typically mounted to a side of a pole in an analogous manner to building facades. Typically, there is very little attempt to conceal the communications antenna, whether on a building facade or roof top or on the side of a pole. In urban and city areas particularly, streetscape environments are typically already cluttered with visual obstructions and the communications antenna make this worse, adding to visual pollution. Further city or urban areas that are planned to have a particular streetscape appearance having these detracted or devalued by the aesthetically unpleasant appearance of these communications antenna mounted in such an ad-hoc way.

GENESIS OF THE INVENTION

The genesis of the invention is a desire to provide a visually improved communications antenna arrangement, or to provide a useful alternative.

SUMMARY OF THE INVENTION

In accordance with a first aspect of the present invention there is disclosed a concealed communication antenna and lighting feature comprising:

- a mount having base configured to be mounted to a structure and having a circumferentially disposed side wall adjacent the circumference of the base wherein the outer side wall extends away from the base a predetermined distance, the base intermediate the circumference thereof and the outer side wall defining a seat, the seat extending a radial distance from the outer side wall to the edge of the base circumference;
- an inner wall disposed concentrically within the outer side wall, the inner side wall extending upwardly substantially the same distance from the base as the outer side wall;
- a plurality of solid state lighting elements mounted to or adjacent to the base intermediate the inner and outer side walls, the lighting elements adapted to direct light away from the base;
- a communications antenna mounted to the inner side wall and upwardly extending predetermined distance therefrom;
- a radome disposed about the antenna and extending a predetermined distance above the inner side wall, the radome being closed at an upper end; and
- a lighting feature lens mounted to the outer wall or on or adjacent the base and extending a predetermined height above the upper end of the radome and being substantially concentric therewith, the lighting feature lens being closed at a top end such that the solid state lighting elements direct light intermediate the radome and the lighting feature lens wherein the lighting feature lens is formed from a transparent or semi-transparent material allowing light from the solid state lighting elements to diffuse therethrough.

It can therefore be seen that there is advantageously provided a communication antenna arrangement having a concealing cover also used as a lighting feature which visually improves the appearance of the communications antenna when mounted to the facade or roof of a building or to a top of a street pole or other structure. Further, the lighting feature does not affect the performance of the antenna.

BRIEF DESCRIPTION OF THE DRAWINGS

A preferred embodiment of the invention will now be described, by way of example only, with reference to the accompanying drawings in which.

DETAILED DESCRIPTION

The preferred embodiment of the concealed communications antenna and lighting feature 2 is shown in FIGS. 2-7 particularly and as preferably mounted to an expedient street pole 1. It will be appreciated that the street pole is merely an exemplary embodiment thereof and the communications antenna and lighting feature 2 can be disposed in any preferred location such as a top a telegraph pole, onto the facade or top of a building or other structure as desired and known.

Figure 1:
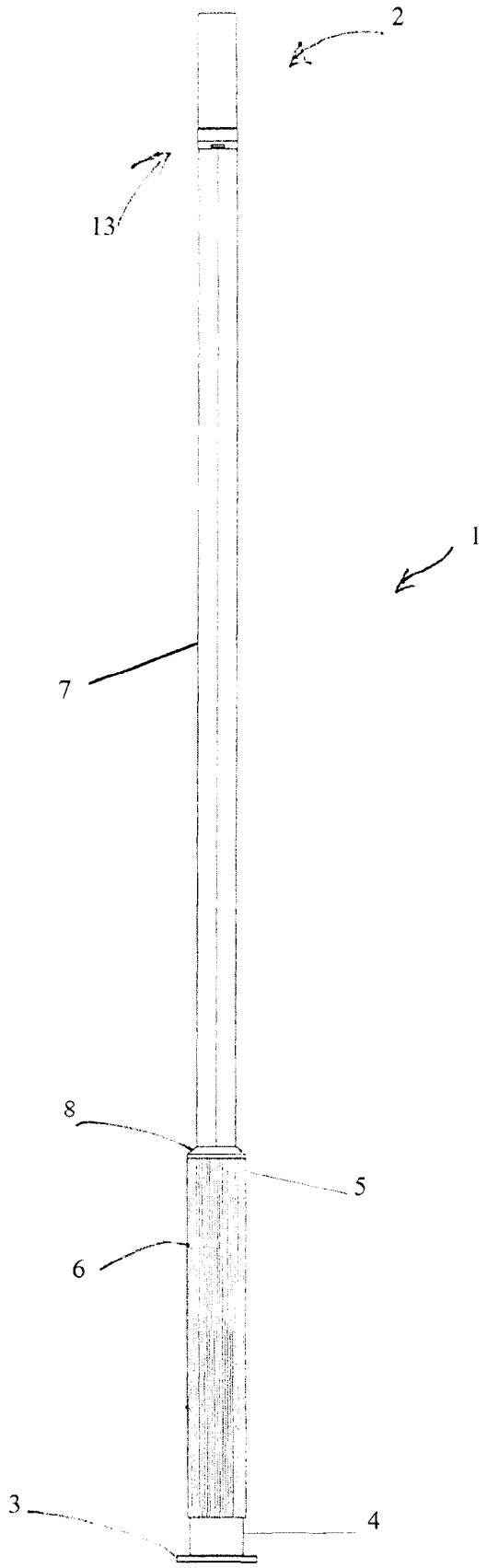
FIG. 1 is a side view of the concealed communications antenna and lighting feature according to the preferred embodiment of the invention disposed on an exemplary street pole.
Figure 2:
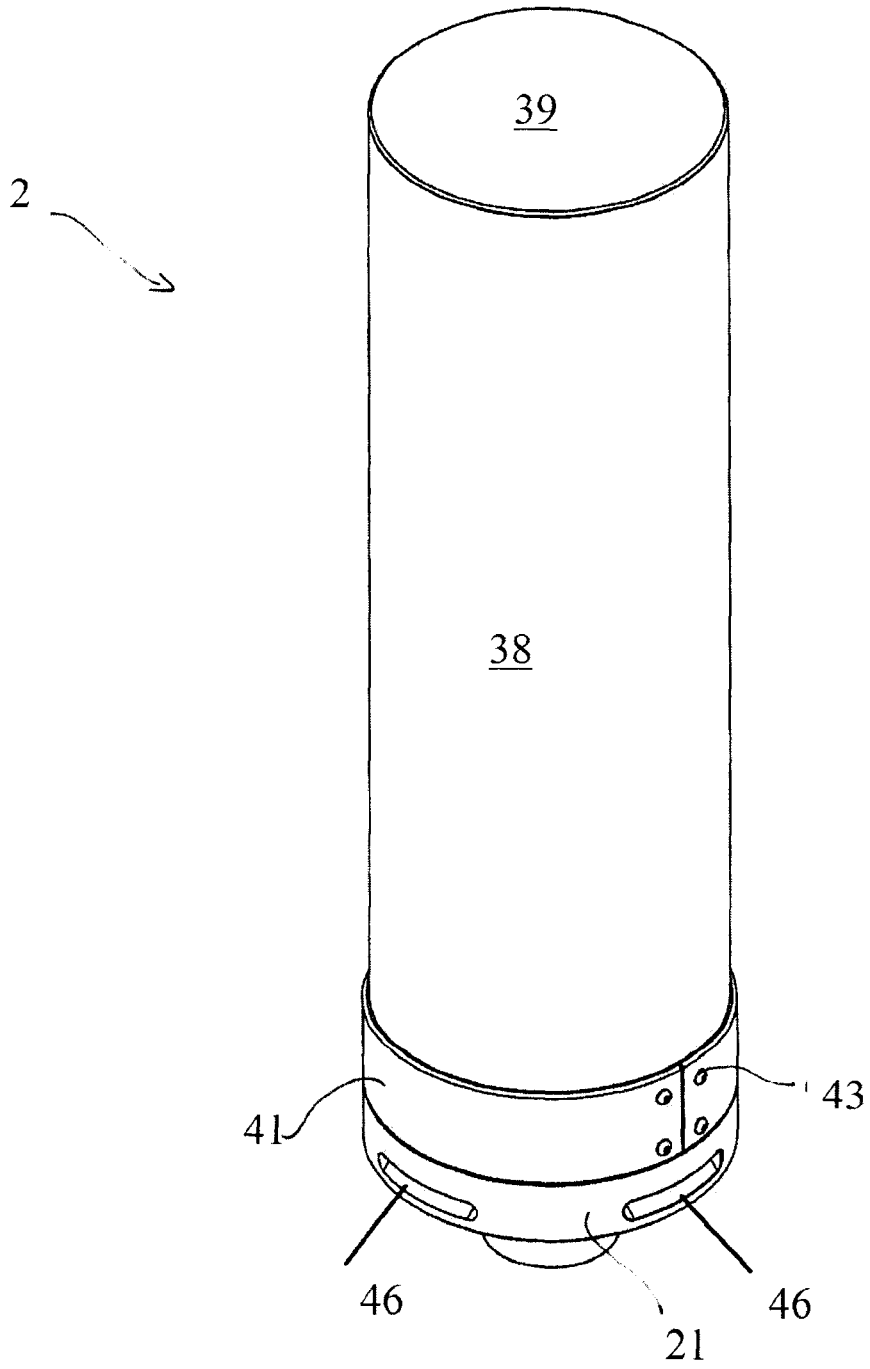
FIG. 2 is an elevated perspective view of the communications antenna and lighting feature of FIG. 1.
Figure 3:
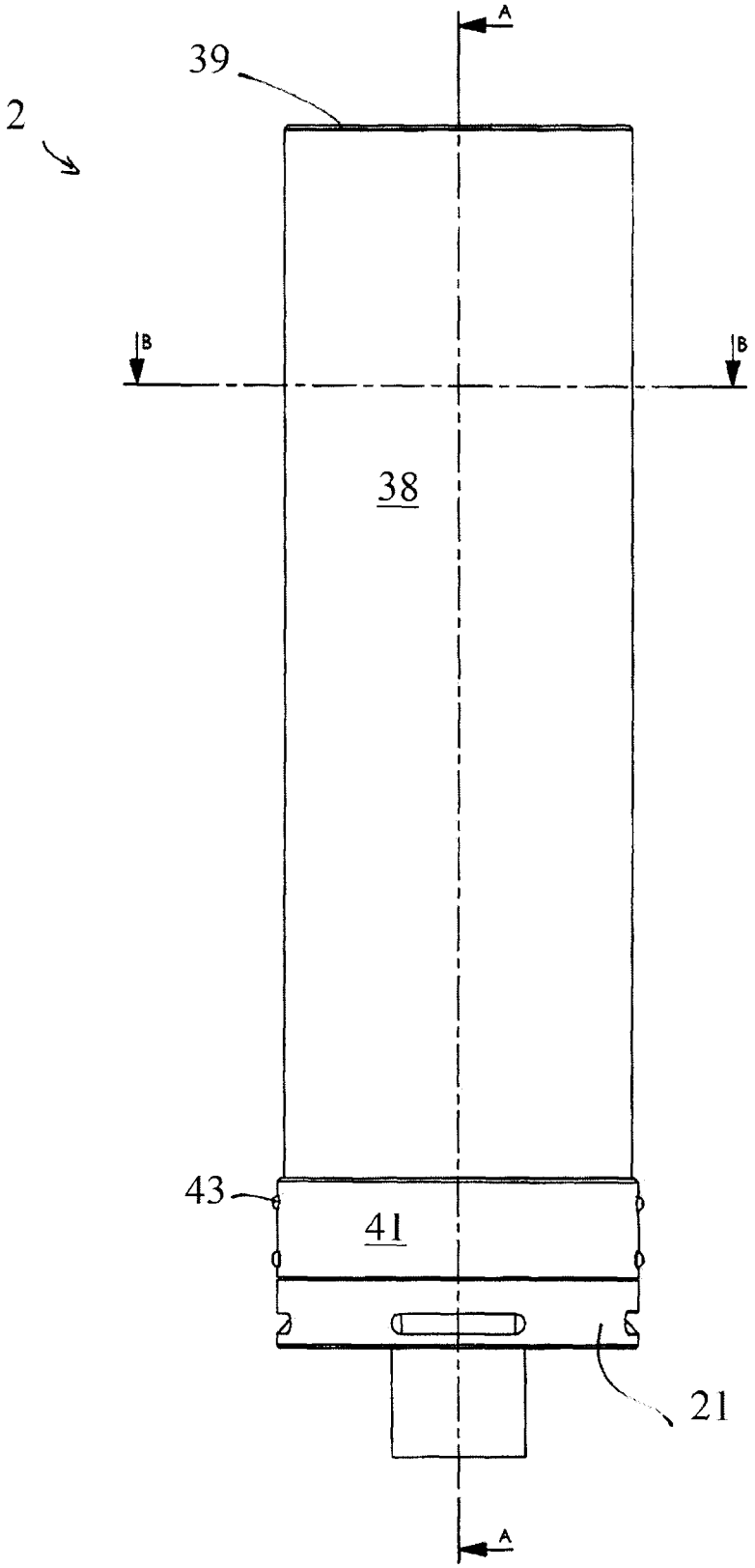
FIG. 3 is a side view of the communications antenna and lighting feature FIG. 1.
Figure 4:
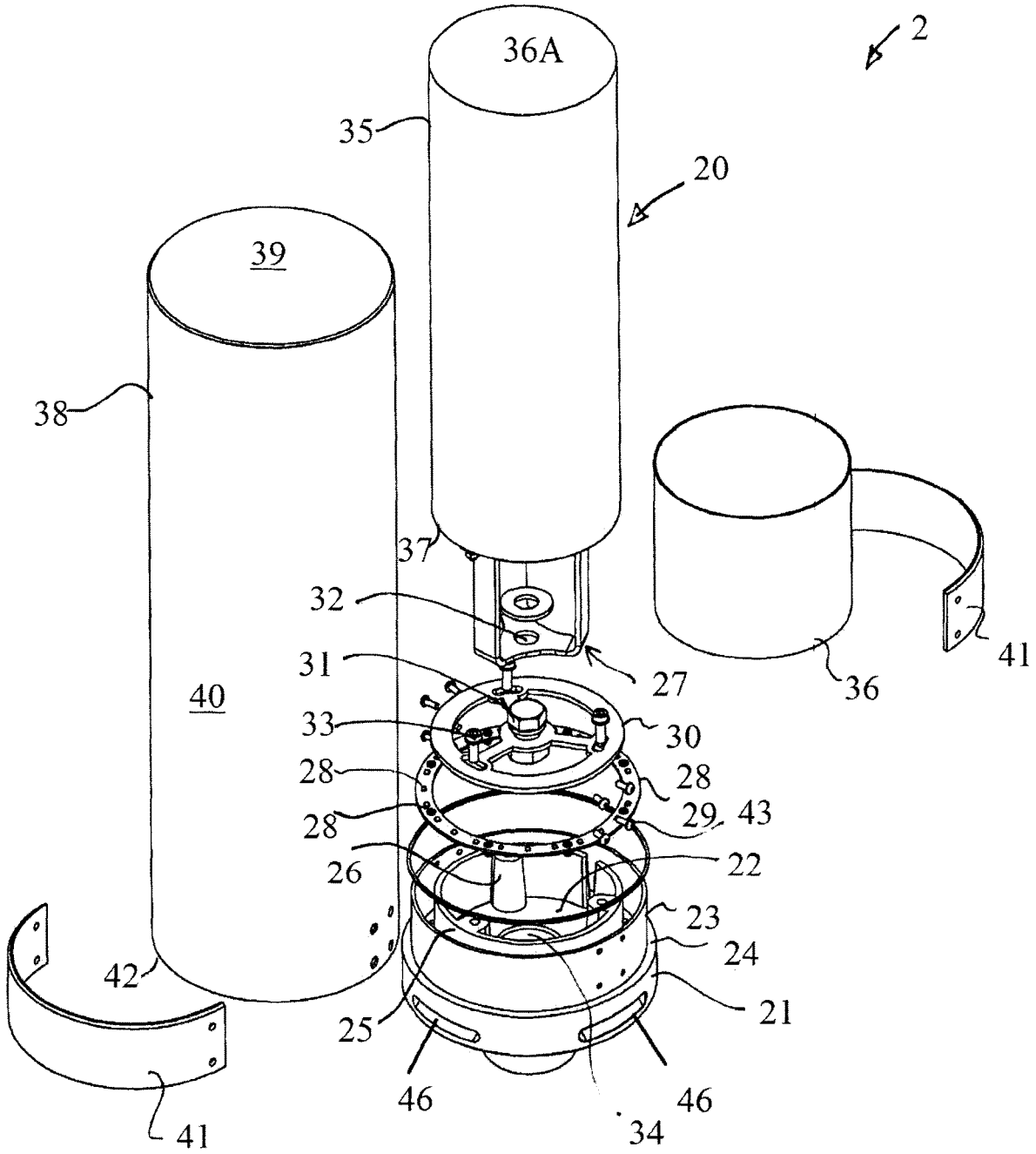
FIG. 4 is an exploded elevated perspective view of the communications antenna and lighting feature FIG. 1.
Figure 5:
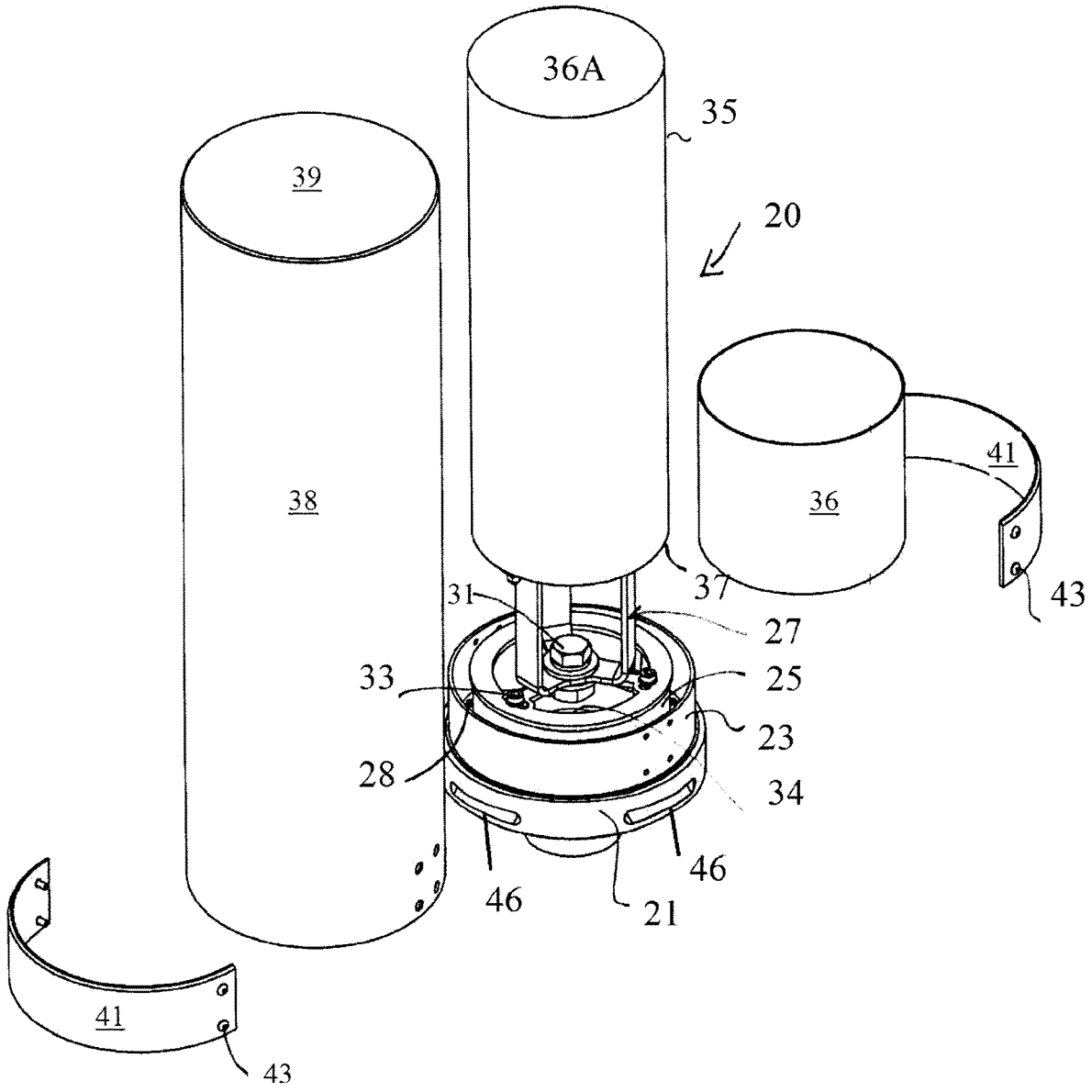
FIG. 5 is a partly exploded elevated perspective view of the communications antenna and lighting feature FIG. 1.
Figure 6:
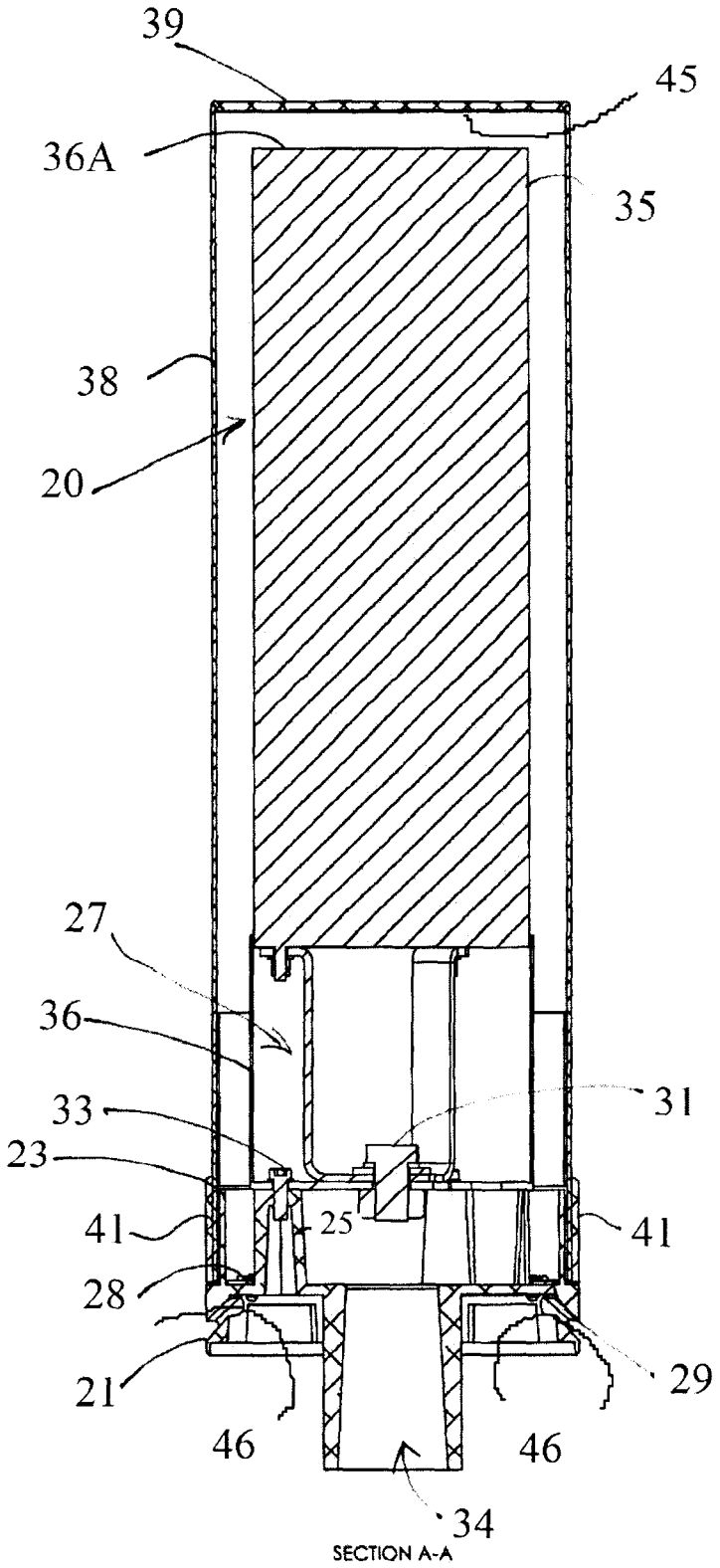
FIG. 6 is a cut away side view along section A-A of the communications antenna and lighting feature FIG. 3.
Figure 7:
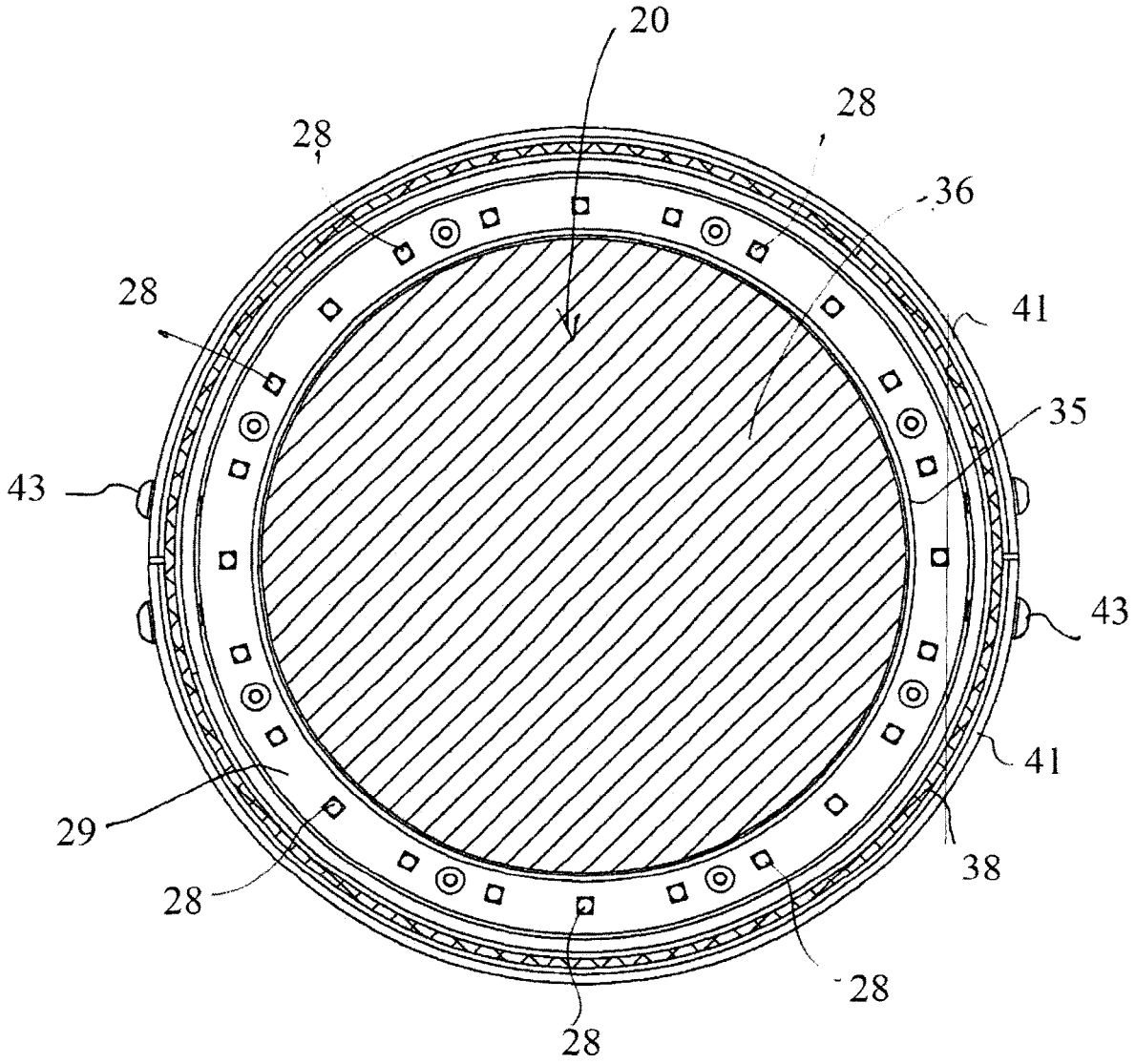
FIG. 7 is a cutaway top view along section B-B of the communications antenna and lighting feature FIG. 3.

Referring to FIG. 1, the street pole 1 extends a predetermined distance above a ground surface (not illustrated). Typically, the street poles 1 are disposed on a curb side adjacent a roadway. However, this could be any locations such as a walk way or any other preferred area where a pole such as in the preferred embodiment of FIG. 1 can be found or erected.

The street pole 1 of the preferred embodiment includes a flange 3 for mounting to a ground surface such as a corresponding mounting flange affixed in a concrete footing, engaging with threaded rods or the like concreted into the ground surface or by simply concreting the pole in the ground, for example. The street pole 1 includes the base section 4 attached to the flange and extending upwardly a predetermined distance therefrom. The base section 4 terminates at an upper end 5 and includes a coaxial external cladding 6 disposed thereabout.

A collar 8 is disposed over the upper end 5 of the base pole section 4 so as to substantially cover the space intermediate the cladding 6 and pole section 4. The concealed communications antenna and lighting feature 2 sits atop elongate pole section 7 extending from upper end 5 of base pole section 4.

Referring now particularly to FIGS. 2-7 showing the preferred embodiment of the concealed communications antenna and lighting feature 2, a substantially cylindrical antenna element 20 adapted for use in a 4G/5G LTE telecommunications system is provided. It will be appreciated that any preferred communications antenna 20 can be used as desired. The specifics of the antenna 20 and electrical connections are not shown in the drawings for clarity.

The communications antenna and lighting feature 2 includes a mount 21. The mount 21 is adapted to be mounted to the upper end 13 of the street pole 1 atop base pole section 4 and extending a predetermined height thereabove. The mount 21 includes a base 22 extending substantially across the top of the mount 21. An outer side wall 23 is circumferentially disposed about the base 22 and extends a predetermined height above it. The outer side wall 23 is radially offset about the circumference of the base 22 to provide a seat 24. An inner side wall 25 is disposed within the outer side wall 23 and is concentric therewith. The inner side wall 25 extends substantially the same distance away from the base 22 as the outer side wall 23. The inner side wall 25 also includes three equally spaced fastening points 26 to receive a lower end 27 of the telecommunications antenna 20 where lower end 27 supports the antenna.

A plurality of solid state lighting elements 28 are disposed on a printed circuit board (PCB) or the like 29 in the form of an annulus. The PCB 29 is disposed on or above base 22 intermediate the inner and outer side walls 23 and 25. The solid state lighting elements 28 are each configured to direct light away from the base 22.

An antenna mounting ring 30 is fastened to fastening point 26 and includes a central mounting nut 31 adapted to fasten antenna support 27 through aperture 32. Screws 33 are used to fasten mounting ring 30 to fastening point 26.

Mounted to the lower end of antenna 27 is the telecommunications antenna (not illustrated). Necessary electrical cables and communication cables are fed through an aperture 34 in the base 22 of the mount 21. These cables are insulated and shielded as necessary. Power and control signal cables for the LED lighting elements 28 are also fed through aperture 34 in mount 21.

The telecommunications antenna 20 includes a radome 35 enclosed at an upper end 36A that extends toward antenna mounting ring 30. The radome 35 is substantially cylindrical and stops a predetermined height above the antenna mounting ring 30. A lower cover element 36 is disposed intermediate the radome 35 at a lower end 37 thereof to the mounting ring 30. The lower cover 36 is substantially the same cross-sectional size as radome 35. Lower cover element 36 is also able to provide a continuation medium between the radome 35. This assisting the scattering or dispersing light throughout the lens so as to minimise light losses that would occur under radome 35.

Mounted over the radome 35 and lower cover 36 is a lighting feature cover 38. The lighting feature cover 38 is preferably semi-transparent and includes a closed upper end 39. The lighting feature cover 38 is substantially cylindrical and a side wall 40 thereof extends from closed upper end 39 to or adjacent to seat 24 on the base 22 concentrically outside of the outer side wall 23. The lighting feature cover 38 is affixed to outer side wall 23 of base 21 by means of cover plates 41 disposed about a lower end 42 of the lighting feature cover 38. The cover plates 41 extend upwards substantially the same height as the outer side wall 23. Fixing screws 43 are used to secure cover plates 41 over the lighting feature cover 38 to the outer side wall 23.

It is noted that closed top end 39 of lighting feature cover 38 is preferably mirrored or otherwise made reflective in an inside surface 45 thereof. This is at the upper end of the decorative light feature (see FIG. 6). This reflects light from surface 45 to assist in containing light that would otherwise be lost or emitted from top end 39, or that would be mostly absorbed in the case of top end 39 being non-reflective or transparent.

It is also noted mount 21 includes a plurality of circumferentially spaced apart vents 46 in the preferred embodiment, in this way hot air from the antenna and lighting feature 2 may be able to flow from within feature 2 and depending on the pole, heat from the upper end 13 of the pole. This can provide a venting effect or the like.

The solid state lighting elements 28 are preferably light emitting diodes (LED's) or organic light omitting diodes (OLED's) but are not limited thereto. The LED light elements can be individually monochromatic and the same or different colours or be able to be selectively actuated to provide predetermined colours or light patterns as desired. In this way, light emitted from elements 28 is directed intermediate inner and outer side walls 23 and 25, and between the radome 35 and lower cover 36 and the lighting feature cover 38. Light diffuses from the lighting feature cover 38 to provide a lighting feature concealing the antenna. Importantly, the lighting feature does not affect the perforce of the antenna.

This provides a much more aesthetically pleasing appearance when the lighting elements 28 are not actuated by concealing the antenna arrangement 20, and serves the additional function of providing a source of light. The antenna and lighting feature 2 can be mounted to a building facade or roof whether directly via mount 21 or indirectly via a bracket or other structures. It will also so appreciated the antenna and lighting feature 2 need not be cylindrical but can be a desired shape or the antenna could be horizontally aligned or vertical (such as shown in the preferred embodiment).

The foregoing describes only one embodiment of the present invention and modifications, obvious to those skilled in the art, can be made thereto without departing from the scope of the present invention.

The term "comprising" (and its grammatical variations) as used herein is used in the inclusive sense of "including" or "having" and not in the exclusive sense of "consisting only of".

The invention claimed is:

1. A concealed communication antenna and lighting feature comprising:

a mount having a base configured to be mounted to a structure and having a circumferentially disposed outer side wall adjacent the circumference of the base wherein the outer side wall extends away from the base a predetermined distance, the base intermediate the circumference thereof and the outer side wall defining a seat, the seat extending a radial distance from the outer side wall to an edge of the circumference of the base;

an inner side wall disposed concentrically within the outer side wall, the inner side wall extending upwardly substantially the same distance from the base as the outer side wall;

a plurality of solid state lighting elements mounted to or adjacent to the base intermediate the inner and outer side walls, the lighting elements adapted to direct light away from the base;

a communications antenna mounted to the inner side wall and upwardly extending predetermined distance therefrom;

a radome disposed about the antenna and extending from a lower end a predetermined distance above the base, the radome being closed at an upper end enclosing the antenna;

a lower cover disposed intermediate the radome lower end and the base; and a lighting feature lens mounted to the outer side wall or on or adjacent the base and extending a predetermined height above the upper end of the radome and being substantially concentric therewith, the lighting feature lens being closed at a top end such that the solid state lighting elements direct light intermediate the radome and the lighting feature lens wherein the lighting feature lens is formed from a transparent or semi-transparent material allowing light from the solid state lighting elements to diffuse therethrough.

2. A communication antenna and lighting feature as claimed in claim 1 wherein the structure is a building facade or roof or mounting platform attached thereto, or an upwardly extending pole.

3. A communication antenna and lighting feature as claimed in claim 2 wherein the communications antenna and lighting feature is mounted vertically or horizontally atop a street pole.

4. A communication antenna and lighting feature as claimed in claim 1 wherein the lighting feature cover is formed from an acrylic or methacrylic polymer.

5. A communication antenna and lighting feature as claimed in claim 1 wherein the communications antenna is a 4G/5G LTE telecommunications antenna.

* * * * *